US008544970B2

(12) United States Patent
Jung et al.

(10) Patent No.: US 8,544,970 B2
(45) Date of Patent: Oct. 1, 2013

(54) GUIDE RAIL ATTACHING STRUCTURE FOR SLIDING DOOR AND REFRIGERATOR HAVING THE SAME

(75) Inventors: Yongki Jung, Changwon (KR); Jaehun Jung, Changwon (KR)

(73) Assignee: LG Electronics Inc., Seoul (KR)

( * ) Notice: Subject to any disclaimer, the term of this patent is extended or adjusted under 35 U.S.C. 154(b) by 112 days.

(21) Appl. No.: 13/216,665

(22) Filed: Aug. 24, 2011

(65) Prior Publication Data

US 2012/0062092 A1 Mar. 15, 2012

(30) Foreign Application Priority Data

Sep. 9, 2010 (KR) ..... 10-2010-0088582

(51) Int. Cl.
*A47B 96/04* (2006.01)
*A47B 88/00* (2006.01)

(52) U.S. Cl.
USPC ..... 312/402; 312/348.1

(58) Field of Classification Search
USPC ..... 312/401, 402, 404, 405, 405.1, 322, 312/348.1, 348.2, 348.4, 324, 319.1, 319.2
See application file for complete search history.

(56) References Cited

U.S. PATENT DOCUMENTS 1,927,828 A * 9/1933 Greenhill ..... 312/237
3,771,847 A * 11/1973 Aylworth ..... 312/245
5,205,015 A * 4/1993 Huang ..... 16/50
5,643,610 A * 7/1997 Beckert et al. ..... 425/12
6,318,824 B1 * 11/2001 LaGrotta et al. ..... 312/322
6,447,083 B1 * 9/2002 Chiapetta et al. ..... 312/404
6,553,623 B2 * 4/2003 Long ..... 16/285
6,565,170 B2 * 5/2003 Banicevic et al. ..... 312/404
6,945,504 B2 * 9/2005 Chen et al. ..... 248/282.1
7,344,208 B2 * 3/2008 Brown ..... 312/332
7,520,022 B2 * 4/2009 Conway et al. ..... 16/285
7,832,816 B2 * 11/2010 Compagnucci ..... 312/334.24
7,987,555 B2 * 8/2011 Chen et al. ..... 16/286
8,231,190 B2 * 7/2012 Ertz et al. ..... 312/402
8,437,123 B2 * 5/2013 Sun ..... 361/679.02
2004/0183415 A1 * 9/2004 Kim ..... 312/402
2009/0193836 A1 * 8/2009 Ertz et al. ..... 62/449
2010/0039007 A1 * 2/2010 Fan et al. ..... 312/223.2

* cited by examiner

*Primary Examiner* — Darnell Jayne
*Assistant Examiner* — Kimberley S Wright
(74) *Attorney, Agent, or Firm* — Ked & Associates, LLP

(57) ABSTRACT

In a guide rail attaching structure for a sliding door and a refrigerator using the same, the structure includes a support member coupled to an inner plate of a door of a refrigerator main body and having support coupling portions, and a pair of guide rails each having a guide rail coupling portion coupled to the corresponding support coupling portion, and slidable with respect to the refrigerator main body, wherein the support coupling portion and the corresponding guide rail coupling portion are coupled to each other by a hinge, whereby a force applied to the guide rail can be minimized to prevent warping of the guide rail even if the sliding door is open in any direction.

20 Claims, 8 Drawing Sheets

GUIDE RAIL ATTACHING STRUCTURE FOR SLIDING DOOR AND REFRIGERATOR HAVING THE SAME

CROSS-REFERENCE TO RELATED APPLICATION

The present disclosure relates to subject matter contained in priority Korean Application No. 10-2010-0088582, filed on Sep. 9, 2010, which is herein expressly incorporated by reference in its entirety.

BACKGROUND OF THE INVENTION

1. Field of the Invention

This specification relates to a guide rail attaching structure for a sliding door and a refrigerator having the same, and more particularly, to a guide rail attaching structure for a sliding door used in a refrigerator.

2. Background of the Invention

In general, a refrigerator is a home alliance, which has a storage space open or closed by a refrigerator door to store foods at low temperature. The refrigerator uses cold air, which is generated by heat exchange of a refrigerant circulating a refrigeration cycle, to keep foods stored in the storage space in a fresh state.

It is a recent trend to require large and multifunctional refrigerators based upon the changes in dietary lives and technical progress. Also, refrigerators having various structures and elements concerning about users' conveniences are released.

FIG. 1 shows a typical bottom-freezer type refrigerator. As shown in FIG. 1, a typical refrigerator has an appearance defined by a main body 1 in an approximately rectangular shape, and includes a storage space for storing foods. The storage space of the refrigerator main body 1 is divided into upper and lower spaces, which define a refrigerating chamber (reference numeral not given) and a freezing chamber (reference numeral not given), respectively.

An open front surface of the refrigerator is open or closed by a pair of left and right refrigerating chamber doors 3, and an open front surface of the freezing chamber is open or closed by one or a plurality of upper and lower freezing chamber doors 4.

The refrigerating chamber door 3 may have both ends coupled to the refrigerator main body 1 by hinges so as to be implemented as a hinged door, and the freezing chamber door 4 is slidably coupled to the refrigerator main body 1 to be implemented as a sliding door.

FIG. 2 shows a guide rail attaching (mounting, installing) structure for a sliding door according to the related art. With the guide rail attaching structure for the sliding door, each guide rail 20 is bonded onto an auxiliary plate 120 by welding 121 and the auxiliary plate 120 is coupled to an inner plate 110 by bolts 123 such that the guide rail 20 is secured. When a side of the sliding door other than a center is pushed or pulled, the door is not smoothly open or closed. Also, when such portion is pushed or pulled by an excessive force, it may be destroyed or deformed, resulting in disabling opening or closing of the door.

SUMMARY OF THE INVENTION

Therefore, to address such problem of the related art, an aspect of the detailed description is to provide a guide rail attaching structure for a sliding door capable of preventing warping of a guide rail by minimizing a force applied to the guide rail even if the sliding door is open in any direction, and a refrigerator having the same.

To achieve these and other advantages and in accordance with the purpose of this specification, as embodied and broadly described herein, a guide rail attaching structure for a sliding door may include a support member coupled to an inner plate of a door of a refrigerator main body and having support coupling portions, and a pair of guide rails each having a guide rail coupling portion coupled to the corresponding support coupling portion, and slidable with respect to the refrigerator main body, wherein the support coupling portion and the corresponding guide rail coupling portion are coupled to each other by a hinge.

The guide rail coupling portion may be coupled to one side of the support coupling portion by a hinge, and the structure may further include connector rails integrally formed with the corresponding guide rails, respectively, each having a connector rail coupling portion coupled to the other side of the support coupling portion by a hinge.

The support member may extend between the pair of guide rails and coupled to the pair of guide rails.

The support members may be coupled to the pair of guide rails, respectively.

The support coupling portion, the guide rail coupling portion and the connector rail coupling portion may be formed as through holes, and hinge-coupled by a pin inserted through all of the through holes.

The structure may further include a torsion spring inserted in the pin and located between the coupling portions, and the torsion spring may have one leg supported by the support member and the other leg supported by the guide rail.

The structure may further include a buffer inserted in the pin and located between the coupling portions.

The buffer may be in form of a foam ring.

The support member may be integrally formed with the inner plate of the door to allow for much stronger coupling.

In accordance with one exemplary embodiment, a refrigerator having guide rails for a sliding door may include a refrigerator main body having a storage chamber therein, a sliding door configured to open or close the storage chamber of the refrigerator main body, a support member formed at an inner plate of the door, and a pair of guide rails both coupled to the support member and slidable with respect to the refrigerator main body, wherein the support member and the guide rails are coupled to each other by hinges.

The support member may extend in a horizontal direction between the pair of guide rails to contact end portions of the guide rails coupled to the door. The support member may include support coupling portions and each guide rail may include a guide rail coupling portion, such that the support coupling portion and the corresponding guide rail coupling portion can be coupled to each other by hinges.

The support member may be implemented as a pair of members extending in a longitudinal direction. Here, each of the support members may include a support coupling portion and each guide rail may include a guide rail coupling portion, such that one side of the support coupling portion can be coupled to the guide rail coupling portion by a hinge. Connector rails may be integrally formed with the respective guide rails and each of the connector rails may include a connector rail coupling portion coupled to the other side of the support coupling portion by a hinge.

The support coupling portion of the support member may be provided in plurality to be hinge-coupled to the guide rail and the connector rail, and the connector rail coupling portion of the connector rail may be provided in plurality in correspondence with the plurality of support coupling portions.

A torsion spring may be disposed at a hinge-coupled portion between the support member and the guide rail, with a predetermined angle, and supported by each one end portion of the support member and the guide rail. The torsion spring may include an elastic restoring force toward the predetermined angle when the support member and the guide rail are rotated.

A torsion spring may be disposed between the coupling portions, and have one leg supported by the support member and the other leg supported by the guide rail.

The support member may be integrally formed with the inner plate of the door.

In accordance with a guide rail attaching structure for a sliding door and a refrigerator having the same, even if the sliding door is open in any direction, a force application the guide rail can be minimized to prevent warping of the guide rail.

Also, deformation of a connector rail caused upon opening the door in a biased direction can be prevented, resulting in avoiding the connector rail from coming apart from the door.

In addition, the support member integrally installed with the door may reinforce rigidity of the door, and a separate bracket for reinforcing such rigidity is not needed, thereby reduction of fabricating cost.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings:

FIGS. 7 and 8 are views showing operating states of the guide rail attaching structure of the sliding door, wherein FIG. 7 shows a state upon an opening operation in a front direction, and FIG. 8 shows a state of an opening operation in a biased direction.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

In a structure that guide rails 20 are welded onto a sliding door 100 according to the related art, when the door 100 is open in a biased direction, a force is applied to the door 100 in an inclined direction whereas the door 100 is open in a forward direction. Accordingly, the guide rails 20 are affected by forces applied due to inconsistency between the direction of force applied to the door 100 and the opening direction of the door 20. Therefore, when a side of the sliding door other than a center is pushed or pulled, the door is not smoothly open or closed. Also, when such portion is pushed or pulled by an excessive force, it may be destroyed or deformed, resulting in disabling open or closing of the door.

As such, the force applied to the guide rail 20 may make the guide rail 20 warped and may be fractured due to a consecutively accumulated fatigue. Hence, this specification aims to preventing the guide rail 20 from being warped by minimizing the force applied to the guide rail 20 even if the sliding door is open in any direction.

Hereinafter, description will be given in detail of the preferred exemplary embodiments with reference to the accompanying drawings.

Figure 1:
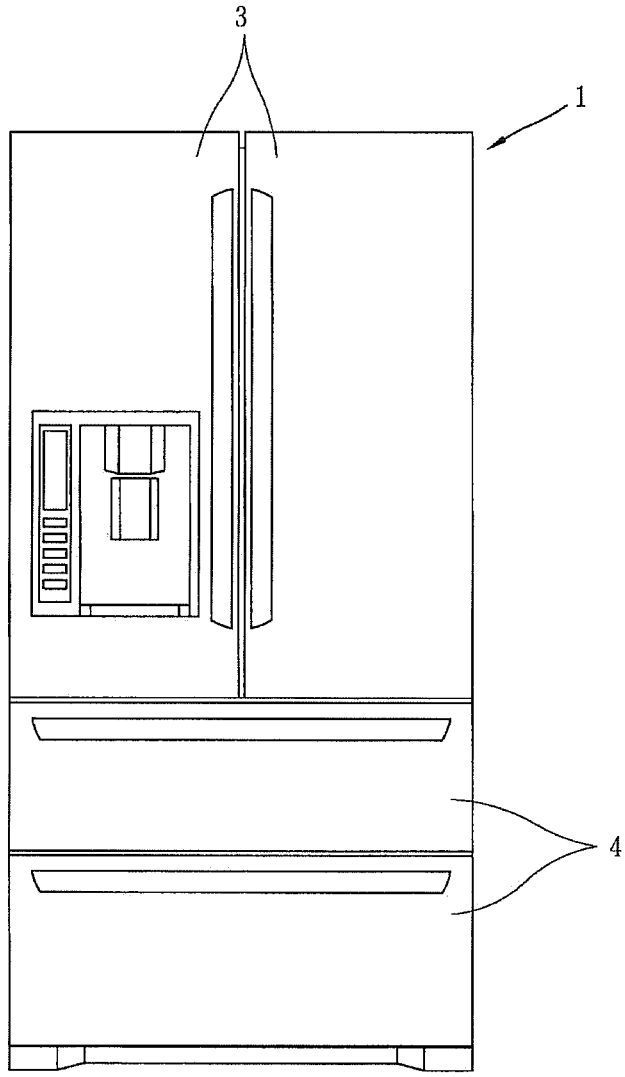
Fig. 1 Conventional Art
FIG. 1 is a view showing a typical bottom-freezer type refrigerator.
Figure 2:
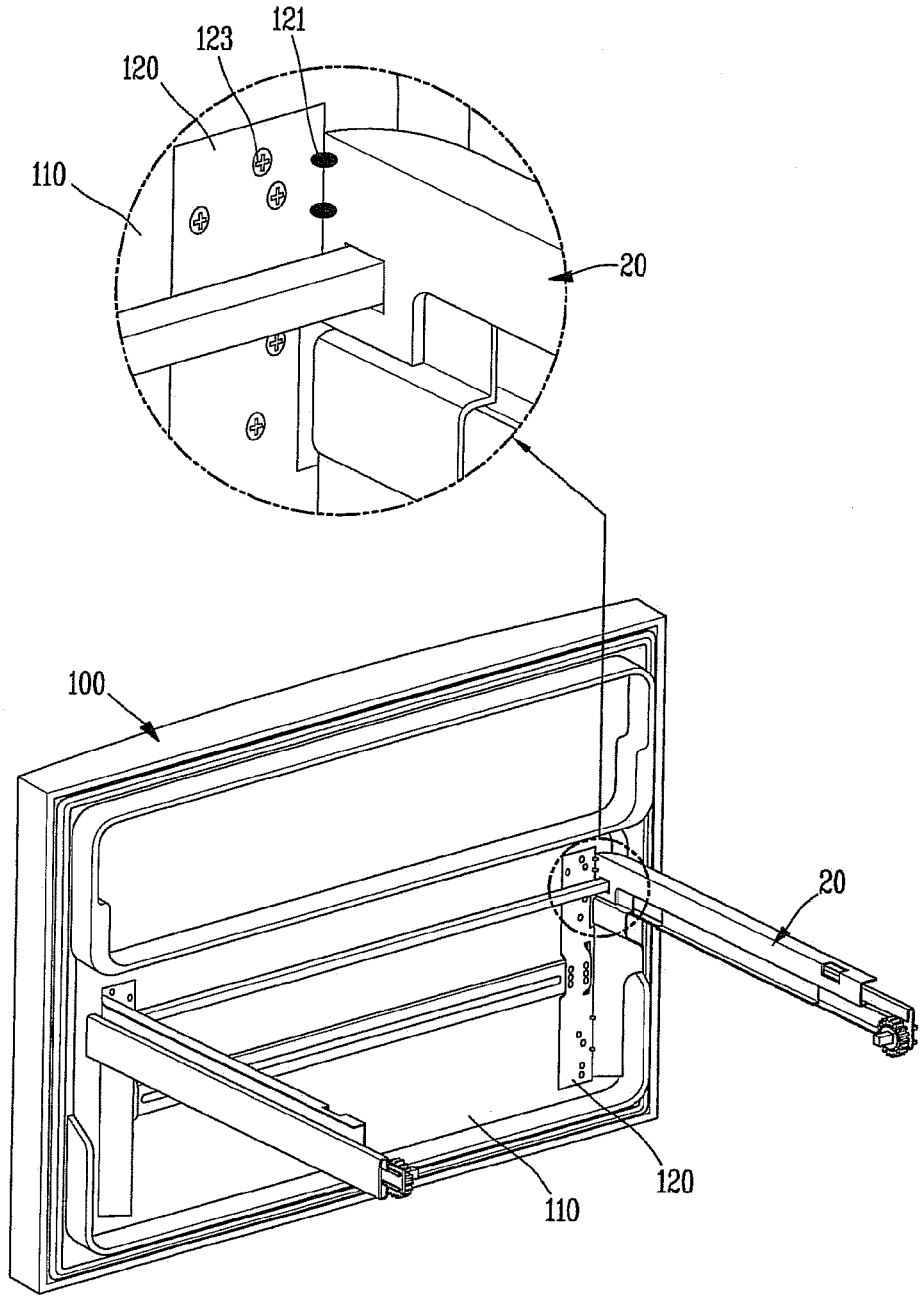
Fig. 2 Conventional Art
FIG. 2 is a perspective view showing a guide rail attaching structure for a sliding door according to the related art.
Figure 3:
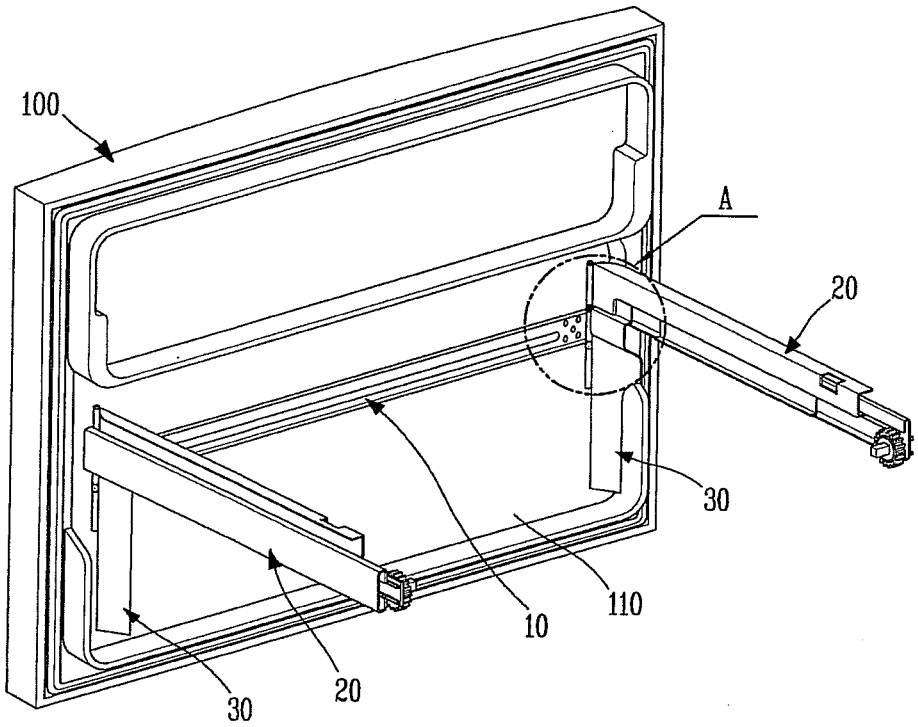
FIG. 3 is a perspective view showing a guide rail attaching structure for a sliding door in accordance with a first exemplary embodiment.
Figure 4:
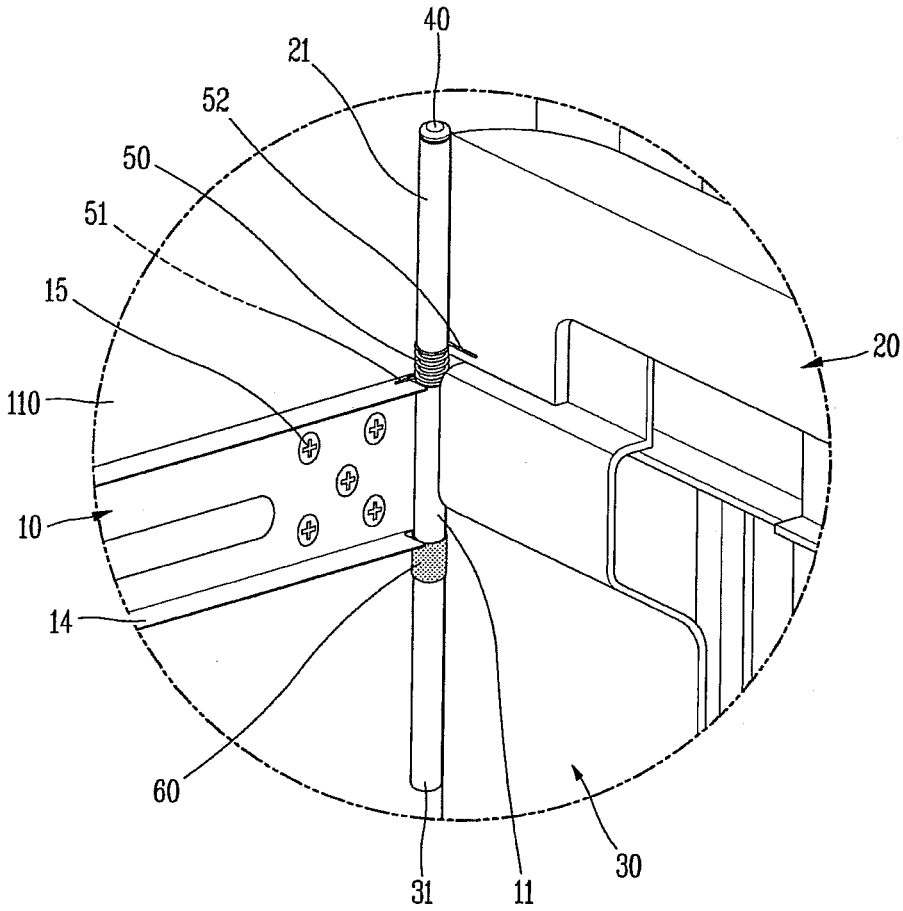
FIG. 4 is an enlarged perspective view of part A of FIG. 3.

FIG. 3 is a perspective view showing a guide rail attaching structure for a sliding door in accordance with a first exemplary embodiment, and FIG. 4 is an enlarged perspective view of part A of FIG. 3.

Referring to FIGS. 3 and 4, a guide rail attaching structure for a sliding door in accordance with a first exemplary embodiment may include a support member 10 and a pair of guide rails 20 coupled to the support member 10 by hinges.

The support member 10 may be coupled to an inner plate 110 of the door 100 and include support coupling portions 11.

More especially, the support member 10 may be in a bar-like shape extending between the pair of guide rails 20, and coupled to the inner plate 10 of the door 100 by bolts 15. The support member 10 may include support coupling portions 11 formed at both ends thereof in form of through holes so as to be coupled to guide rail coupling portions 21 of the guide rails 20, to be explained later, by hinges.

As the support member 10 extends between the pair of guide rails 20 to be coupled to the inner plate 110 of the door 100, the pair of guide rails 20 and the support member 10 can be integrated with each other. Consequently, when an external force is applied to the door 100, the door 100 can be supported more firmly.

Here, referring to FIG. 4, the support member 10 may include bent ribs 14 bent and protruded forwardly from upper and lower end portions. The support member 10 extends long in a horizontal direction between the guide rails 20, so the bent ribs 14 can hold out a shear stress with respect to a vertical (longitudinal) direction of the door 100. The bent ribs 14 may function to support the door 100 much more firmly when the door 100 is affected by the shear stress responsive to an external force.

Therefore, the rigidity of the door 100 can be reinforced by the support member 10 integrally installed with the door 100 and the bent ribs 14, and also reduction of fabricating cost can be derived due to no need to install a separate bracket for reinforcing rigidity.

The foregoing description has been given of the structure that the support member 10 is coupled to the separately configured inner plate 110 of the door 100. Alternatively, the support member 10 may be integrally formed at the inner plate 110 of the door 100 to be hinge-coupled to the guide rails 20, which will be explained later.

Thus, when the support member 10 is integrally formed at the inner plate 110 of the door 100, the guide rails 20 can be coupled to the door 100 more strongly by hinges.

Each of the guide rails 20 may include a guide rail coupling portion 21 coupled to the corresponding support coupling portion 11 and be slidable from the refrigerator main body 1.

More particularly, each of the guide rails 20 may include the guide rail coupling portion 21. The guide rail coupling portion 21 may be coupled to one side of the support coupling portion 11 belonging to the support member 10 by a hinge. Also, the guide rail 20 can be slidable with respect to the refrigerator main body 1.

Also, a connector rail 30 having a connector rail coupling portion 31 may be coupled to the other side of each support coupling portion 11 by a hinge. Each connector rail 30 may be integrally formed with the guide rail 20 or separately formed from the guide rail 20 to be integrally coupled to the guide rail 20, thereby reinforcing the rigidity of the guide rail 20.

According to the coupling structure, based upon the support member 10, the guide rail coupling portion 21 of each guide rail 20 may be coupled by a hinge to the upper portion of the support coupling portion 11 of the support member 10 and the connector rail coupling portion 31 of each connector rail 30 may be coupled by a hinge to the lower portion of the support coupling portion 11.

As the support coupling portion 11, the guide rail coupling portion 21 and the connector rail coupling portion 31 are coupled together by hinges, the inner plate 110 of the sliding door 100 may be rotatable centering around the hinge-coupled point as a shaft, whereby the sliding door 100 may be rotatable with respect to each guide rail 20.

Here, the support coupling portion 11, the guide rail coupling portion 21 and the connector rail coupling portion 31 may be formed as through holes. Accordingly, a pin 40 may be inserted through each of the through holes to allow for hinge-coupling of those coupling portions 11, 21 and 31. For the hinge-coupling using the pin, it may be facilitated to couple the guide rails 20 to the support member 10 or separate them from each other by inserting or removing the pin 40. Hence, when any component is destroyed, the corresponding component can be replaced by easily disassembling those coupling portions.

A torsion spring 50 may be installed between the support coupling portion 11 and the guide rail coupling portion 21.

In more detail, the torsion spring 50 may be located between the support coupling portion 11 and the guide rail coupling portion 21 in an inserted state in the pin 40. One leg 51 of the torsion spring 50 may be supported by the support member 10 and the other leg 52 may be supported by the guide rail 20 so as to make the guide rail 20 and the support member 10 form a predetermined angle by its restoring force.

The employment of the torsion spring 50 may prevent the door 100 from being sharply rotated with respect to the hinge-coupled point where the support coupling portion 11 and the guide rail coupling portion 21 are coupled to each other. Here, the torsion spring 50 may have a modulus of elasticity appropriate for allowing the door 100 to be rotatable by an appropriate angle when being open by an eccentric force in a biased direction.

A buffer 60 may be installed between the support coupling portion 11 and the connector rail coupling portions 31.

In more detail, the buffer 60 may be a foam ring, which has a hole through the center thereof. Accordingly, the buffer 60 may be located between the support coupling portion 11 and the connector rail coupling portion 31 with being inserted in the pin 40 through the central hole. The buffer 60 may be formed of a material capable of adsorbing vibration so as to prevent generation of noise or shaking, which may be caused during hinge rotation of those coupling portions when opening the sliding door 100 in the biased direction.

The torsion spring 50 has been illustrated as located between the support coupling portion 11 and the guide rail coupling portion 21 and the buffer 60 has been illustrated as located between the support coupling portion 11 and the connector rail coupling portion 31. However, the torsion spring 50 may alternatively be located between the support coupling portion 11 and the connector rail coupling portion 31 and the buffer 60 may alternatively be located between the support coupling portion 11 and the guide rail coupling portion 21.

According to the related art, when the door 100 is open by an eccentric force in the biased direction, warping may be caused at the connector rail 30. Excessive warping may result in a permanent deformation of the connector rail 30. However, according to this specification, the torsion spring 50 may help the connector rail 30 to be restored without concern about the permanent deformation, and prevent the connector rail 30 from coming apart (detached) from the door 100 upon opening or closing the door 100.

The foregoing description has been given of the hinge-coupling among the support member 10, the guide rails 20 and the connector rails 30. However, a hinge coupling only between the support member 10 and the guide rails 20 without the connector rails 30 may alternatively be employed. Also, the hinge coupling has been described as the pin coupling. Any of generally well-known hinge coupling structures may also be applicable.

Hereinafter, description will be given of a guide rail attaching structure for the sliding door 100 in accordance with a second exemplary embodiment. The following description may use the same/like reference numbers for the same/like components as the first exemplary embodiment and description thereof will not be repeated.

Figure 5:
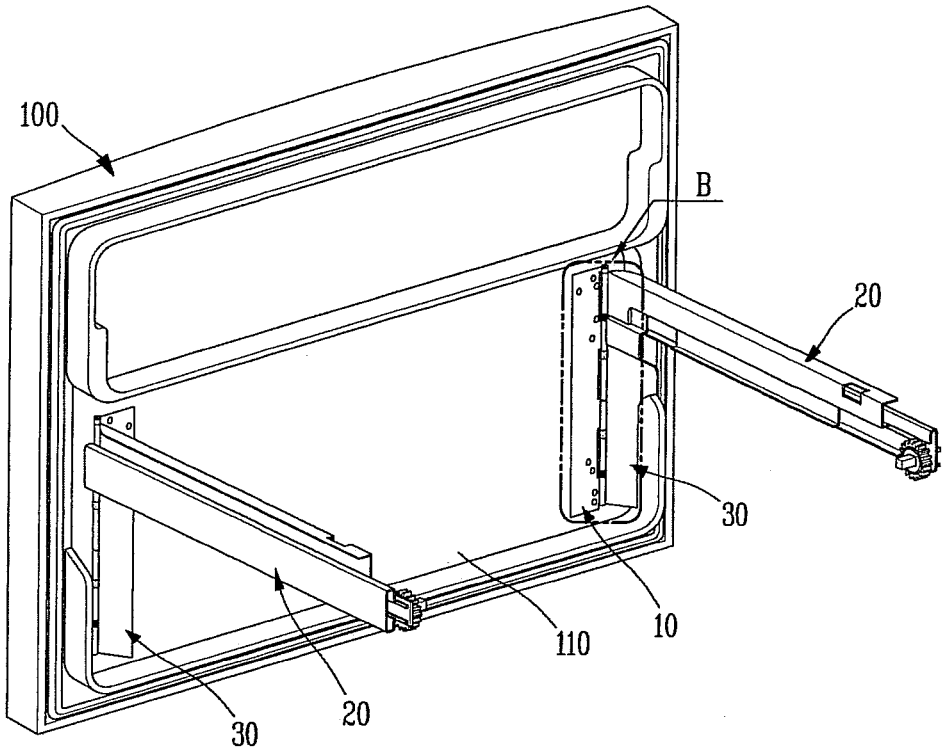
FIG. 5 is a perspective view showing a guide rail attaching structure for a sliding door in accordance with a second exemplary embodiment.
Figure 6:
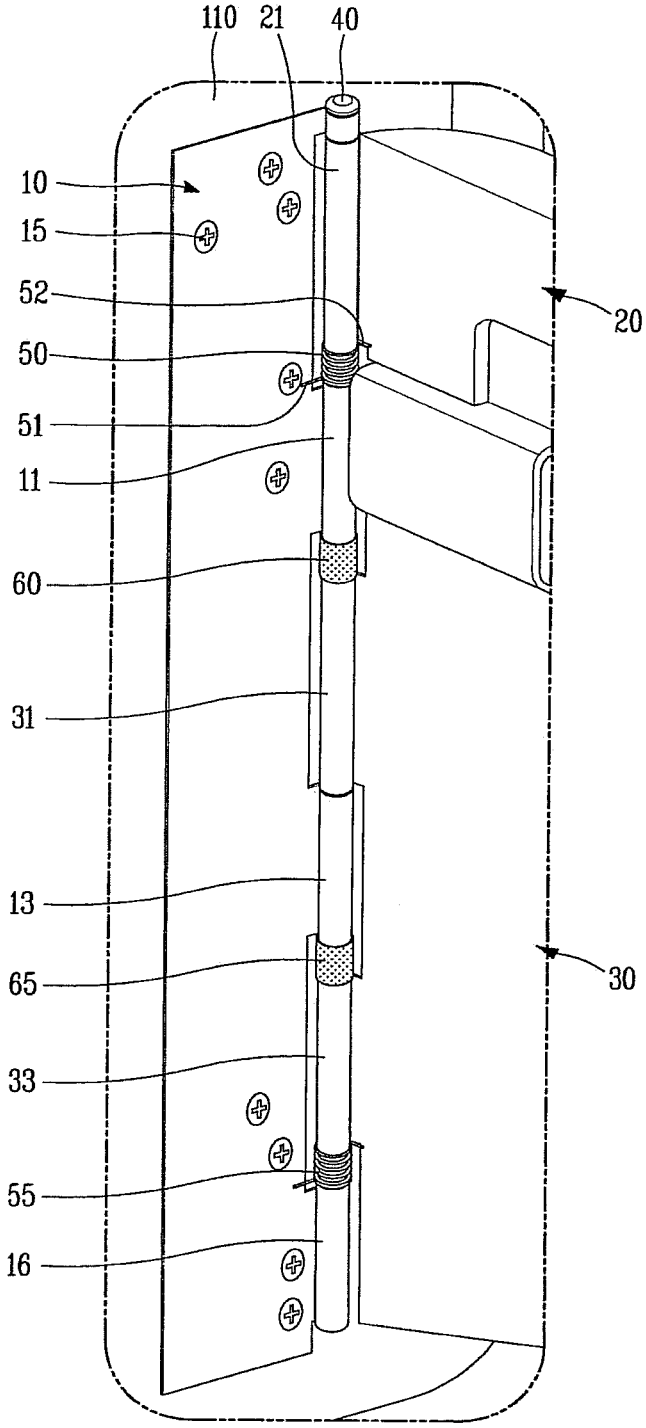
FIG. 6 is an enlarged perspective view of part B of FIG. 5.

FIG. 5 is a perspective view showing a guide rail attaching structure for a sliding door in accordance with a second exemplary embodiment, and FIG. 6 is an enlarged perspective view of part B of FIG. 5.

In accordance with the second exemplary embodiment, the support members 10 may be coupled to the guide rails 20, respectively. Also, a plurality of coupling portions may be formed at the support member 10 and the connector rail 30, respectively.

In more detail, the support member 10 may be in a shape of a rectangular plate. The support members 10 may be coupled respectively to left and right sides of the inner plate 110 to extend in longitudinal direction of the door 100, and coupled respectively to the guide rails 20 by hinges.

Each of the support members 10 may include a first support coupling portion 11, a second support coupling portion 13 and a third support coupling portions 16 with predetermined intervals from one another. Each of the connector rails 30 may further include a second connector rail coupling portion 33 coupled between the second support coupling portion 13 and the third support coupling portion 16. Here, each coupling portion may be formed as a through hole. In the above coupled state, the pin 40 may be inserted through each of the coupling portions.

A buffer 65 may further be provided between the second support coupling portion 13 and the second connector rail coupling portion 33, and a torsion spring 55 may further be provided between the second connector rail coupling portion 33 and the third support coupling portion 16, thereby reinforcing a buffering function and a restoring function.

In the configuration that the support members 10 are coupled to the guide rails 20, respectively, the shape of the support member 10 may be freely selected or adopted. Accordingly, as aforementioned, more coupling portions may be made to be coupled to the connector rail 30 at plural portions, resulting in improvement in view of function.

In the foregoing description, the support member 10 and the connector rail 30 have the plurality of coupling portions. However, a configuration may also be possible that the support member 10 may have only the support coupling portion 11, and the connector rail 30 has only the connector rail coupling portion 31.

Hereinafter, description will be given in detail of an operation of the guide rail attaching structure for the sliding door with reference to the corresponding drawings.

Figure 7:
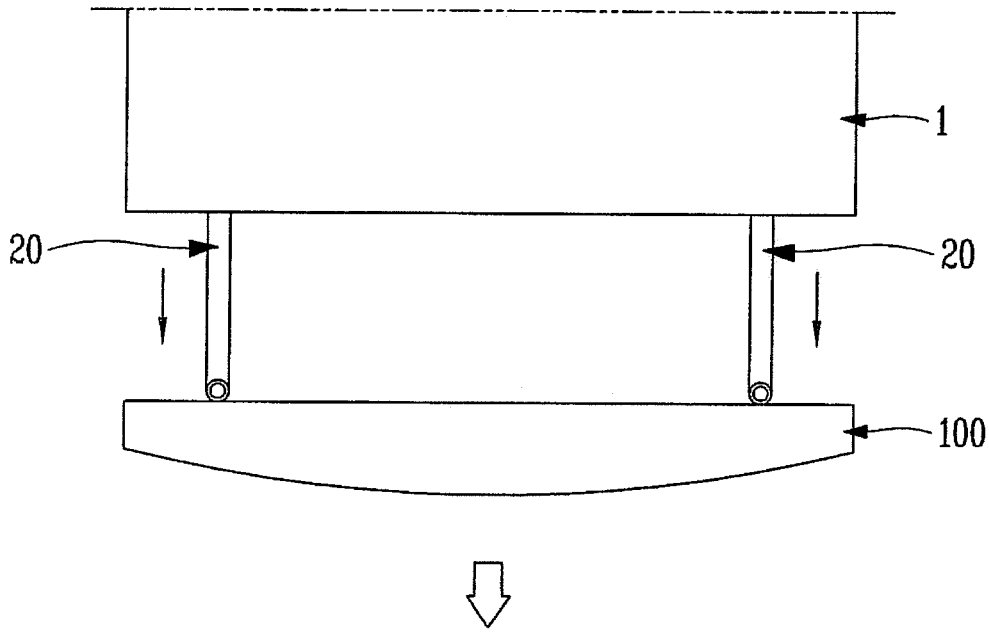
Figure 8:
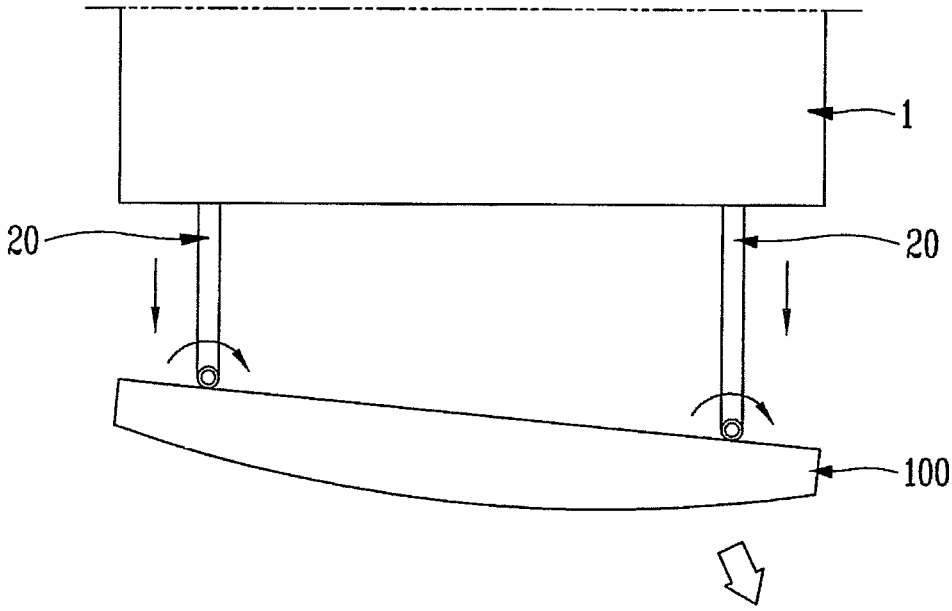

FIGS. 7 and 8 are views showing operating states of the guide rail attaching structure of the sliding door, wherein FIG. 7 shows a state upon an opening operation in a front direction, and FIG. 8 shows a state of an opening operation in a biased direction.

When a user opens the door 100 in front (in a forward direction), referring to FIG. 7, a direction of a force applied for opening the door 100 from the refrigerator main body 1 and an opening direction of the door 100 are equal to each other. Hence, the hinge-coupled portions between the guide rails 20 and the supporting member 10 may remain in the original state.

When the user opens the door 100 in a biased direction, referring to FIG. 8, the direction of the force applied for opening the door 100 from the refrigerator main body 1 and the opening direction of the door are different from each other. Accordingly, the hinge-coupled portions between the guide rails 20 and the supporting member 10 are rotated in directions indicated by arrows, thereby blocking forces applied to the guide rails 20 or the connector rails 30.

Here, the torsion spring 50 may apply a force in a direction to maintain (or restore) the original state of the door 100. Accordingly, when the user stops eccentric (biased) opening of the door 100, the door 100 may be restored to the original state.

Consequently, even when the sliding door 100 for the refrigerator is open in a biased direction, the force applied to the guide rail 20 can be minimized to prevent generation of warping of the guide rail 20 or the connector rail 30, which results in prevention the connector rail 30 from coming apart (detached) from the door 100.

As another exemplary embodiment of this specification, a refrigerator having guide rails for a sliding door may include a refrigerator main body 1 having a storage chamber therein, a sliding door 100 for opening or closing the storage chamber of the refrigerator main body 1, a support member 10 formed at an inner plate of the door 100, and a pair of guide rails 20 coupled to the support member 10 and slidable with respect to the refrigerator main body 1, wherein the support member 10 and the guide rails 20 are coupled to each other by hinges.

Here, the support member 10 may be integrally formed with the inner plate of the door 100 to allow for stronger coupling.

The support member 10 may extend in a horizontal direction between the pair of guide rails 20 to contact one end portion of each guide rail 20 coupled to the door 100. The support member 10 may include support coupling portions 11 and each guide rail 20 may include a guide rail coupling portion 21 such that the support coupling portions 11 and the guide rail coupling portions 21 can be coupled to each other, respectively, by hinges.

The support member 10 may be implemented as a pair of members each extending in a longitudinal direction from an installation position of the corresponding guide rail 20.

With this structure, each of the support members 10 may include a support coupling portion 11 and each guide rail 20 may include a guide rail coupling portion 21 such that one side of the support coupling portion can be coupled to the guide rail coupling portion by a hinge. The refrigerator may further include connector rails 30 integrally formed with the guide rails 20 and each having a connector rail coupling portion 31 coupled to the other side of the support coupling portion 11 by a hinge.

The support coupling portion of the support member 10 may include a plurality of support coupling portions to be coupled to the guide rails and the connector rails by hinges. The connector rail coupling portion of the connector rail 30 may also include a plurality of connector rail coupling portions in correspondence with the support coupling portions.

The refrigerator may further include a torsion spring 50 located at the hinge-coupled portion between the support member 10 and the guide rail 20 to allow the support member 10 and the guide rail 20 form a predetermined angle, and supported by each end portion of the support member 10 and the guide rail 20, wherein the torsion spring 50 has an elastic restoring force toward the predetermined angle when the support member 10 and the guide rail 20 are rotated in response to a biased opening.

The torsion spring 50 may be located between the coupling portions 11, 21, 31. One leg 51 of the torsion spring 50 may be supported by the support member 10, and the other leg 52 of the torsion spring 50 may be supported by the guide rail 20.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A guide rail attachment adapted for attachment to a sliding door of a refrigerator main body comprising:

a support member adapted to be coupled to an inner plate of the door and having support coupling portions formed at a right and left end of the support member;

a pair of guide rails each having a guide rail coupling portion coupled to one of the support coupling portions, the guide rail coupling portions extending in an up and down direction, the guide rails being slidable with respect to the refrigerator main body; and a pin extending through support coupling portion and a respective guide rail coupling portion in the up and down direction, wherein the support coupling portion and the corresponding guide rail coupling portion are coupled to each other to be relatively rotatable about the pins, and wherein the door is rotatable with respect to the guide rails in the right and left direction.

2. The attachment of claim 1, further comprising connector rails integrally formed with the corresponding guide rails, respectively, each having a connector rail coupling portion coupled to an other side of the support coupling portion to be relatively rotatable thereto.

3. The attachment of claim 1, wherein the support member extends between the pair of guide rails and is coupled to the pair of guide rails.

4. The attachment of claim 3, wherein the support member comprises bent ribs that protrude forwardly from upper and lower end portions thereof.

5. The attachment of claim 2, wherein the support coupling portion, the guide rail coupling portion and the connector rail coupling portion are formed as through holes, such that one of the pins is inserted therethrough.

6. The attachment of claim 5, further comprising a torsion spring located between each support coupling portion and one of the guide rail coupling portions and/or between each support coupling portion and one of the connector rail coupling portions, each pin extending through one of the torsion springs.

7. The attachment of claim 6, wherein the torsion spring has one leg supported by the support member and the other leg supported by the guide rail.

8. The attachment of claim 3, further comprising a buffer located between each support coupling portion and one of the guide rail coupling portions and/or between each support coupling portion and one of the connector rail coupling portions, each pin extending though one of the buffers.

9. The structure of claim 8, wherein the buffer is in form of a foam ring.

10. A refrigerator having a guide rail attachment for a sliding door comprising:

a refrigerator main body having a storage chamber therein;

a sliding door configured to open or close the storage chamber of the refrigerator main body;

a support member formed on an inner plate of the door and having support coupling portions formed at a right and left end of the support member; and a pair of guide rails each having a guide rail coupling portion coupled to one of the support coupling portions, the guide rail coupling portions extending in an up and down direction, the guide rail being slidable with respect to the refrigerator main body; and a pin extending through each support coupling portion and each respective guide rail coupling portion in the up and down direction, wherein the support member and the guide rails are coupled to each other to be relatively rotatable, and wherein the door is rotatable about each pin, and wherein the door is rotatable with respect to the guide rails in the right and left direction.

11. The refrigerator of claim 10, wherein the support member extends in a horizontal direction between the pair of guide rails to contact end portions of the guide rails coupled to the door.

12. The refrigerator of claim 10, wherein the support member is implemented as a pair of members extending in a longitudinal direction, wherein each of the support members comprises the support coupling portion, and one side of the support coupling portion is coupled to the guide rail coupling portion to be relatively rotatable, and wherein connector rails are integrally formed with the respective guide rails and each of the connector rails comprises a connector rail coupling portion coupled to an other side of the support coupling portion to be relatively rotatable.

13. The refrigerator of claim 12, wherein the support coupling portion of the support member is provided in plurality to be coupled to the guide rail and the connector rail to be relatively rotatable, and wherein the connector rail coupling portion of the connector rail is provided in plurality in correspondence with the plurality of support coupling portions.

14. The refrigerator of claim 10, wherein a torsion spring is located between each support coupling portion and one of the guide rail coupling portions and/or between each support coupling portion and one of the connector rail coupling portions, each pin extending through one of the torsion springs, and with a predetermined angle, the torsion spring having an elastic restoring force toward the predetermined angle when the support member and the guide rail are rotated.

15. The refrigerator of claim 11, wherein a torsion spring is located between the each support coupling portion and one of the guide rail coupling portions and/or between each support coupling portion and the connector rail coupling portion, each pin extending through one of the torsion springs, the torsion spring having one leg supported by the support member and an other leg supported by the guide rail.

16. The refrigerator of claim 10, wherein the support member is integrally formed with the inner plate of the door.

17. A guide rail attachment adapted for attachment to a sliding door of a refrigerator main body comprising:

a support member adapted to be attached to and extending laterally across an inner plate of the door, the support member having support coupling portions formed at a right end and a left end of the support member, the support coupling portions forming hinge knuckles whose axes extend transversely up and down relative to the support member;

a pair of guide rails attached to the refrigerator main body, the guide rails being slidable with respect to the refrigerator main body, each guide rail having a guide rail coupling portion formed at an end thereof, the guide rail coupling portions forming hinge knuckles whose axes extend transversely up and down relative to the guide rail; and pins extending through each support member knuckle and guide rail knuckle, respectively, to form a hinges between the support member and each of the guiderails to permit rotation of the sliding door about the pins and wherein the sliding door is rotatable with respect to the guide rails in the right and left directions.

18. The guide rail attachment of claim 17, further a connector rail integrally formed with each guide rail, respectively, each having a connector rail coupling portion, the connector rail coupling portions forming hinge knuckles whose axes extend transversely up and down relative to the connector rail, the pins extending through each connector rail knuckle to further form the hinge.

19. The attachment of claim 18, further comprising a torsion spring located between one of each support coupling knuckle and each respective guide rail coupling knuckle or between each support coupling knuckle and each respective connector rail coupling knuckle, each pin extending through the respective torsion spring.

20. The attachment of claim 19, further comprising an annular buffer located between the other of each support coupling knuckle and each respective guide rail coupling knuckle or between each support coupling knuckle and each respective connector rail coupling knuckle, each pin extending through the respective buffers.

* * * * *